United States Patent [19]

Lewis et al.

[11] 4,286,249

[45] Aug. 25, 1981

[54] ATTACHMENT OF LEADS TO PRECISION RESISTORS

[75] Inventors: Kenneth R. Lewis, Broomall; Anthony C. Meenan, West Chester, both of Pa.

[73] Assignee: Vishay Intertechnology, Inc., Malvern, Pa.

[21] Appl. No.: 103,549

[22] Filed: Dec. 13, 1979

Related U.S. Application Data

[63] Continuation of Ser. No. 892,122, Mar. 31, 1978.

[51] Int. Cl.[3] ..... H01C 1/034

[52] U.S. Cl. ..... 338/275; 338/195; 338/329

[58] Field of Search ..... 338/275, 262, 195, 329, 338/330, 322, 254; 29/613, 619, 621

[56] References Cited

U.S. PATENT DOCUMENTS

| | | | |
|---|---|---|---|
| 3,824,521 | 7/1974 | Horii et al. | 338/275 |
| 3,922,628 | 11/1975 | Hudson et al. | 338/2 |
| 4,138,656 | 2/1979 | Resnicow | 338/322 |
| 4,176,445 | 12/1979 | Solow | 29/62 X |

FOREIGN PATENT DOCUMENTS

| | | | |
|---|---|---|---|
| 2828070 | 4/1979 | Fed. Rep. of Germany | 338/195 |
| 550433 | 1/1943 | United Kingdom | 338/254 |

*Primary Examiner*—C. L. Albritton

*Attorney, Agent, or Firm*—Weiser, Stapler & Spivak

[57] ABSTRACT

A precision resistor has a thin resistive foil cemented to a much thicker rigid substrate. The foil has formed therein a pattern defining the resistive path between terminal pads. Copper leads can be spot-welded directly to these pads without damage to the junction. To that end, apertures are provided through the terminal pads, through which cement softened by the spot-welding heat can locally expand and gas evolved under pressure can escape, all without adversely affecting the junction and without substantial lifting of the terminal pads from the substrate.

25 Claims, 8 Drawing Figures

FIG. 1
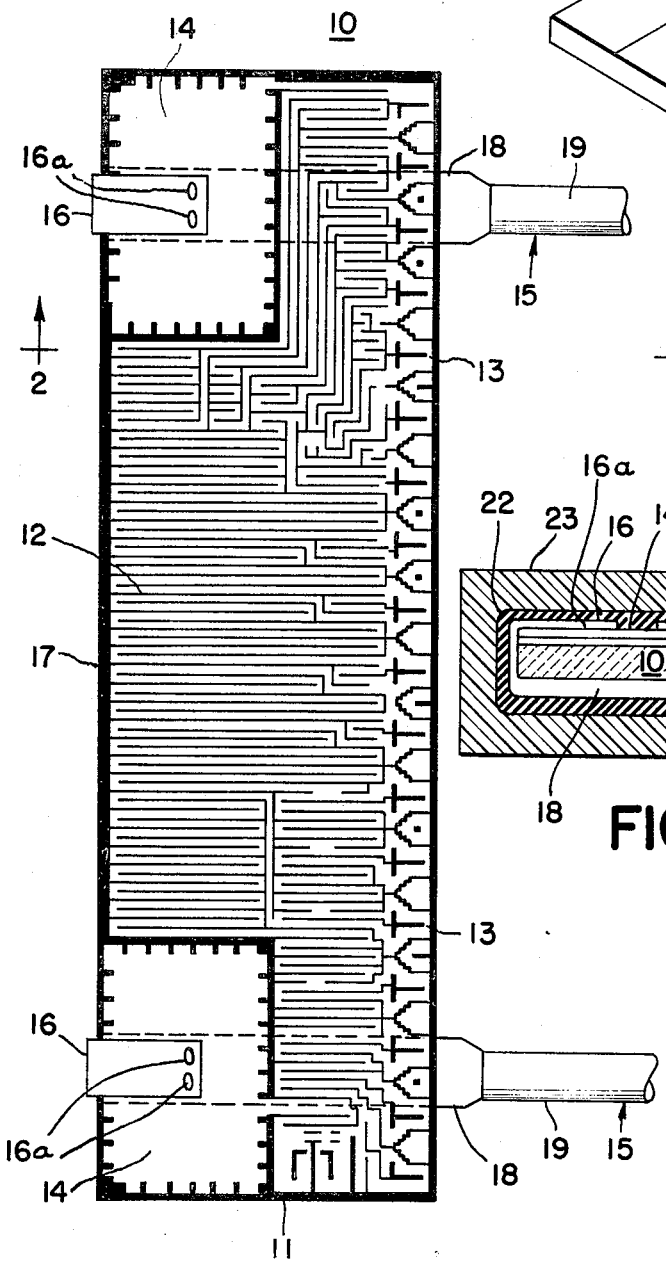
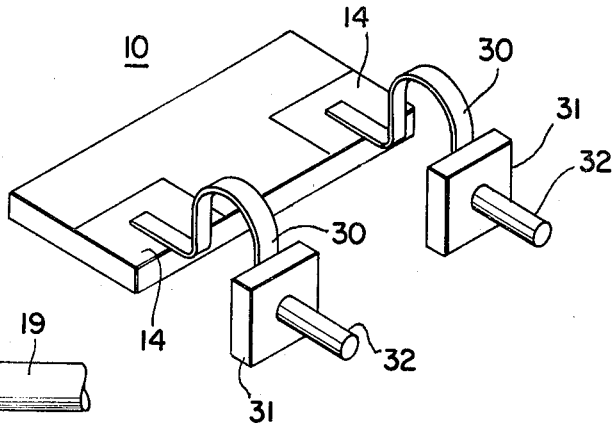
FIG. 3
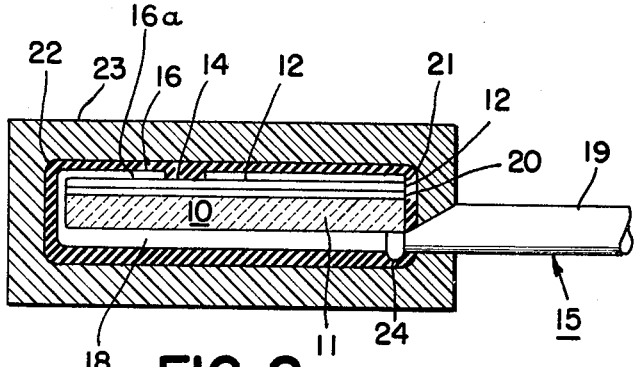
FIG. 2

ATTACHMENT OF LEADS TO PRECISION RESISTORS

This is a continuation application Ser. No. 892,122, filed Mar. 31, 1978.

This invention relates to precision resistors having high stability and low temperature coefficients. In particular the invention relates to such resistors which are made of a rigid substrate (e.g. glass, ceramic, or metal) to which is cemented a foil of resistive material. To produce the proper resistance value, the foil is photoetched in a suitable pattern. This pattern is then further adjusted, if necessary, to the appropriate tolerance by cutting lines in the pattern or reducing its thickness. As a result there is created between the terminal pads of the foil an elongated path of the resistive material exhibiting the desired value of resistance.

Precision resistors of the type identified above have been known for some time, and various aspects thereof have been the subject of prior inventive activity. By way of illustration of such prior knowledge and inventive activity, reference is made to U.S. Pat. Nos. 3,405,381 and 3,517,436, of F. Zandman et al, to U.S. Pat. No. 3,718,883 of Berman et al, and to copending U.S. patent application Ser. No. 742,030 of Leon Resnicow and Ser. No. 814,291 of Joseph Szwarc. All of these patents and patent applications are assigned to the same assignee as the present application, and their contents are hereby incorporated in this application by reference as fully as though set forth at length herein.

As is known from the foregoing "prior art", the production of the precision resistors under consideration also involves application to the resistive foil of a so-called overcoat which consists of a thin layer of plastic. The cutting of the foil for tolerancing may be accomplished either before or after application of the overcoat.

To further protect the resistor from outside forces, there is applied an enveloping cushion of a very soft rubber, or rubber-like material, and ultimately the resistor is encapsulated in a case or molded for still further protection.

In addition to all the foregoing, it is of course necessary to provide connecting leads for such a resistor.

Various techniques have been employed for this purpose.

One known technique involves welding thin ribbons of cupron (a Ni-Cu alloy) or manganin (a Mn-Cu alloy) at one end to the terminal pads of the resistive foil and at the other end to comparatively heavy loads, e.g. of copper. The external connections to the resistor are then effected by means of the heavy leads, which protrude from the case or molding enclosing the resistor.

The intermediate connecting ribbons between the foil terminal pads and the heavy copper leads have been used because the resistive foil is typically made of nickel-chromium alloy of the order of 100 microinches thickness, and it is considered difficult to connect heavy copper leads directly to that foil. Soldering has been considered, but has proven difficult. Moreover, soldering tends to create joints which do not always provide adequate electrical and mechanical connections, when the resistor is to be used in high-reliability applications.

From both electrical and mechanical considerations, it has been regarded as preferable to electrically spot-weld the connecting leads directly to terminal pads of the resistive foil. Consequently, a great deal of research and intensive effort has been devoted to devising a technique for so connecting copper leads directly to the nickel-chromium pads.

From the electrical standpoint, cupron ribbon for example produces comparatively high thermal electromotive forces when connected to the nickel-chromium at one end and to the copper leads at the other end. This high thermal e.m.f. is produced at the junction between the ribbon and the heavy copper leads, because there is a temperature gradient due to the presence of plastic insulation between the two copper connecting leads. In contrast, copper leads connected directly to the nickel-chromium foil produce a thermal e.m.f. which is much lower, indeed lower by a factor of 10 or more. This is because the foil is cemented to a rigid substrate, which provides much better heat conduction than the plastic insulation, and therefore also provides much improved temperature equalization. In addition copper is compatible with the nickel-chromium foil itself, from the point of view of the thermal e.m.f. produced at the junctions between the copper leads and the foil terminal pads.

From the mechanical standpoint, the thin ribbons, e.g. of cupron, which have been used are very flexible, and contribute nothing to the strength of the structure. On the contrary, they allow the substrate and foil to assume various positions with respect to the heavy copper leads, and this makes more difficult the subsequent encapsulating through molding or encasing.

In addition, these thin ribbons are fragile and rupture rather easily. Such rupture of a connecting ribbon obviously renders the entire resistor completely useless.

A technique was therefore developed in which copper leads were directly spot-welded to the foil terminal pads, without the intervention of thin intermediate ribbons.

This technique is the specific subject of the above-referenced U.S. patent application Ser. No. 742,030. As set forth in that application, the end portions of copper leads are flattened and these flattened end portions are then spot-welded to the terminal pads of the resistive foil itself. As previously explained, this greatly reduces the thermal e.m.f. In addition, the flattened copper end portions of the leads can be made to provide relatively strong and rigid mechanical support for the substrate-and-foil portion of the resistor. The positioning of the resistor for encapsulation becomes more secure, and the tendency for connecting leads to rupture is reduced.

However, in applying this flattened-lead technique, there has manifested itself another problem.

This problem is that the union between the terminal pads and their underlying rigid substrate tended to suffer when the flattened copper leads were attached to these pads.

In some cases, this manifested itself by a lifting of the pads, or at least portions of the pads, from their desired positions united to the substrate. In other cases, this problem manifested itself by "running" of the cement which unites the pads to the substrate out from under the edges of the pads. In still other cases, both of these manifestations were observed. In any of these cases, the practical result was that the junctions produced were unreliable, and in some cases actually caused the resistor to fail in service.

Numerous attempts were made to deal with this problem. These involved controlling the spot-welding operation, e.g. as to current intensity, pressure, or both, trying out different types of cement, making changes in the physical dimensions of the flattened copper leads, and so forth. However, even after these parameters appeared to have been explored, the above-mentioned problem still persisted, causing a substantial reject rate of resistors produced by this technique.

Accordingly, it is a primary object of this invention to provide a resistor of the type under consideration which is substantially free of the above-described problem.

It is another object to provide such a resistor in which the terminal pad junctions are electrically and mechanically reliable.

It is still another object to provide such a resistor in which the terminal pad junctions are made by spot-welding flat copper leads to the resistor terminal pads.

It is still another object to provide such terminal pad junctions in which there is no substantial lifting of the terminal pads from the substrate.

These and other objects which will appear are achieved in accordance with the present invention by providing the terminal pads of the resistors with one or more apertures extending through the thickness of the pad, and spot-welding the flat copper leads to these pads. Thereafter the resistor may be processed to completion in the same manner as had been used previously for resistors using flattened copper leads spot-welded to the terminal pads.

It has been found that the foregoing technique utilizing apertures in the terminal pads overcomes the problem previously encountered.

It is believed that the reasons for this are the following.

During the spot-welding operation, there are created elevated local temperatures which soften the cement holding the foil to the substrate. This is what has previously been causing the cement to run out from between the foil and the substrate. By providing apertures within the terminal pad area, it is possible for small quantities of this softened cement to expand locally through these apertures, but without having the space between pad and substrate so denuded of cement that adhesion is disrupted.

Moreover—and perhaps even more importantly—during spot-welding there evolves gas at the foil-cement interface. This gas can be locally at very high pressure. Its presence causes the foil to tend to lift up from the substrate, particularly since the cement has simultaneously become softened. This gas pressure also causes the softened cement to be extruded from between the foil and the substrate, as previously explained. The apertures in the pads which are provided in accordance with this invention negate these phenomena by providing local escape for the gas, without lifting of the pads or extensive extrusion of the cement.

For further details, reference is made to the description which follows in light of the accompanying drawings wherein FIG. 1 shows in top view the basic configuration of foil-bearing substrate with flattened copper leads attached to the terminal pads.

FIG. 2 shows a cross-sectional elevation taken along 2—2 of the assembly of FIG. 1, encapsulated in its various protective elements.

FIG. 3 shows in isometric view the use of intermediate ribbon connections between terminal pads and heavy copper leads for a precision foil resistor.

The same reference numerals designate similar elements in the several drawings.

Figure 4:
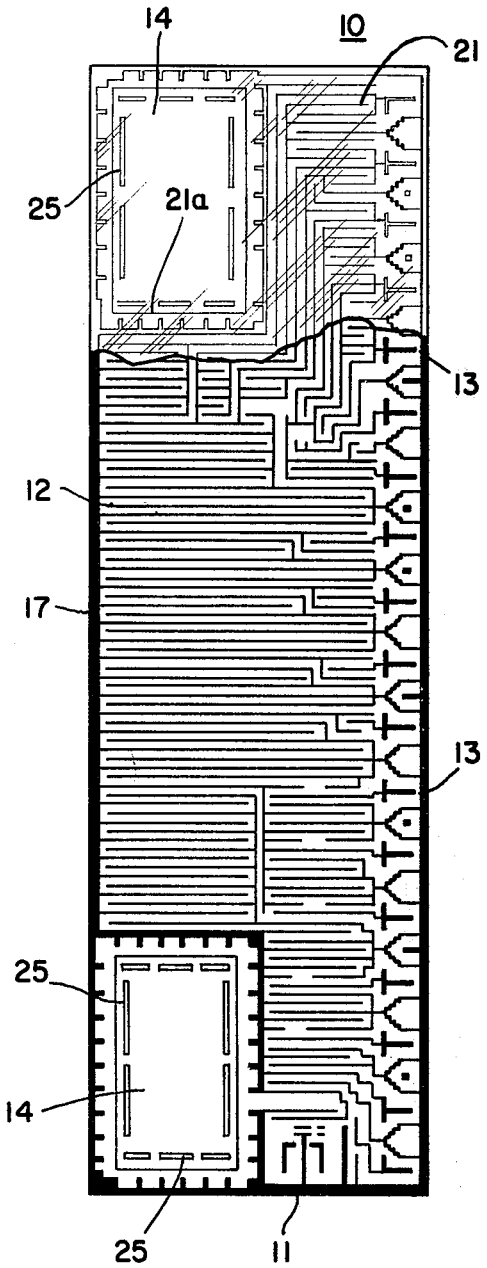
FIG. 4 shows in top view a resistive foil-bearing substrate embodying the present invention.
Figure 5:
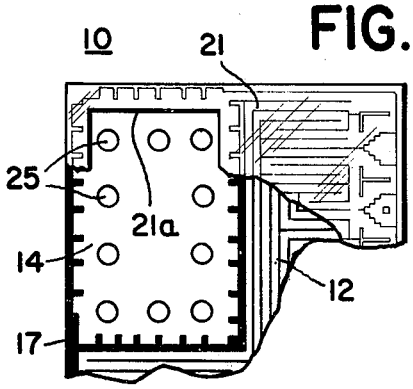
FIGS. 5 through 8 show top views of alternative embodiments of terminal pads for foil-bearing substrates in accordance with the present invention.
Figure 6:
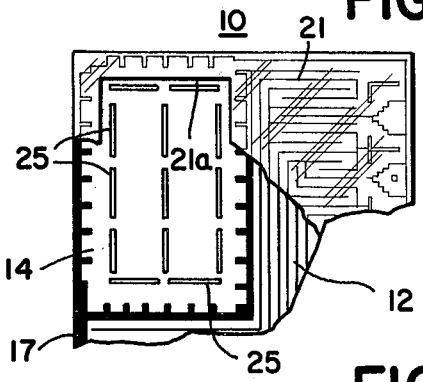
Figure 7:
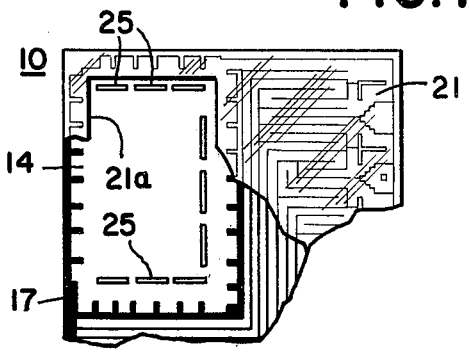
Figure 8:
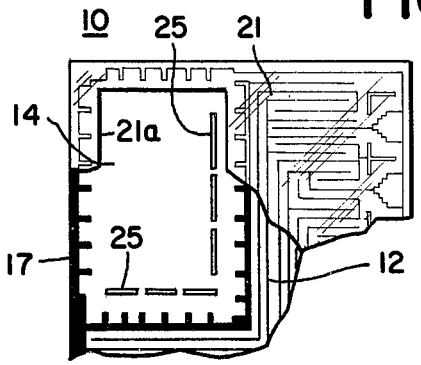

Referring now to the drawings, FIG. 1 shows an assembly 10 of a substrate 11, which may for example be made of ceramic, and upon which there is visible in FIG. 1 a foil 12 of resistive material, e.g. nickel-chromium. This foil 12 is attached to the substrate 11 by a layer of cement (not apparent in FIG. 1). Initially, this foil 12 may extend continuously over substantially the entire substrate 11. However, by the time the stage of manufacture shown in FIG. 1 has been reached, the foil 12 has already been subjected to a series of treatments of known type, as a result of which there is formed in this foil an extended serpentine path separated by thin divisions. Photo-etching can be performed also before cementing, using a temporary support. Also provided along the edge of foil 12 are tab portions 13, in which it is possible to make cuts through the foil during the process of adjusting the resistance of the component during a subsequent stage of manufacture. Also provided in foil 12 are terminal pads 14 at which the opposite ends of the serpentine path terminate.

This construction of the substrate-borne foil is known in itself. Even the specific configuration of serpentine path, adjusting tabs 13, and terminal pads 14 which is shown for illustration in FIG. 1 is known, having been disclosed, for example, in the above-mentioned copending application Ser. No. 814,291 (FIG. 3*a*). As explained in that prior copending application, this particular configuration has certain advantages from the standpoint of adjustment of the resistor to its desired value, because of the logarithmic progression of different sections of the serpentine path. However, it will be understood that for the purposes of the present invention the specific configuration of the serpentine path within the resistive foil is a matter of choice and is not limited to the particular configuration illustrated.

External connections to the foil 12 in FIG. 1 are made by means of leads 15. These consist of copper leads which are flat and comparatively thin and narrow in those end portions 16 that extend onto and into contact with terminal pads 14. These end portions 16 of the leads then turn downwardly (into the page in FIG. 1) past the long edge 17 of the substrate 11. At the bottom of substrate 11, the leads 15 then turn again and pass across the reverse side of substrate 11, i.e. the side not visible in FIG. 1. These portions 18 of leads 15 are indicated in broken lines in FIG. 1. They are also flat, but preferably both thicker and wider than end portions 16. Finally, the leads 15 have portions 19 which may be copper leads of conventional configuration, round, square or rectangular. In practice, lead portions 16, 18 and 19 may all be formed from the same copper wire stock. Portions 16 and 18 may be formed from that stock by suitably flattening the ends. The widened intermediate portion 18 may be simply the inherent result of lateral spreading of the lead during flattening. On the other hand, the narrower end portion 16 may be formed by appropriately cutting way lateral edge portions of the flattened lead over the length of segment 16.

It is desired to emphasize that this configuration of leads 15 and their positioning with respect to assembly 10 is known. It is taught, for example, in the above-identified prior copending U.S. patent application Ser. No. 742,030.

It is also known from that application to affix these leads 15 to terminal pads 14 of assembly 10 by means of spot-welding, as diagrammatically indicated by reference numerals 16*a* in FIG. 1. Indeed, it is this spot-welding which, although a desirable method of attaching the end portions 16 of leads 15 to the terminal pads 14, is believed to give rise to the problem of cement extrusion, foil lifting, or both.

FIG. 2, to which reference may now be had, again shows the assembly 10 of substrate 11 and foil 12. However, since FIG. 2 is an elevation, the cement layer 20 between substrate 11 and foil 12 is also apparent in FIG.2.

Also shown in FIG. 2 is the protective overcoat 21, preferably of epoxy, which is typically placed above the foil 12 for the protection of the serpentine path of that coating which is visible in FIG. 1. The overcoat 21 does not extend over the pads 14.

Enveloping the substrate 11, with the resistive foil 12 attached by cement layer 20 and the epoxy protective overcoat 21, there is a cushion 22, which is made of soft rubber or rubber-like material. Further enclosing this cushion 22 is an outer envelope 23, which may be either of molded plastic, such as epoxy, or may be a plastic case into which the other elements have previously been inserted and which is then filled with encapsulating material, such as epoxy.

The copper leads 15, and particularly their conventional portions 19, protrude outwardly from this outer envelope 23 and serve as external connections to the resistor.

In order to secure these leads 15 before encapsulation, there are preferably provided not only the spot-welds 16*a* but also one or more beads 24 of a suitable plastic adhesive material positioned as shown in FIG. 2, where the leads 15 first meet the corner of substrate 11. Such a bead or beads may be positioned along leads 15 at any desired location for reinforcement purposes. Together with the encircling configuration of the leads 15 around assembly 10, these beads 24 hold the leads and assembly together both during the spot-welding of the leads at 16*a* and also during the subsequent completion of the encapsulated resistor.

FIG. 3, to which reference may now be had, shows another known type of connection to a foil-and-substrate assembly such as designated by reference numeral 10 in FIGS. 1 and 2. In this instance, the connections to terminal pad 14 are provided by thin ribbons 30, e.g. of cupron, which are spot-welded at one end to the terminal pads 14 of assembly 10. At their opposite ends, these cupron ribbons 30 are welded to terminal blocks 31, at which there also terminate conventional copper leads 32. It is only after these connections shown in FIG. 3 have been made that the resulting structure is further enveloped in a rubber cushion, and then encapsulated so that only the free ends of copper leads 32 ultimately protrude. These subsequent stages of construction are not shown because they are not necessary to an understanding of the present invention. Moreover, it will be recognized that the apparatus shown in FIG. 3 corresponds in substance to the foil-and-substrate assembly with connections thereto which is disclosed in the above-mentioned U.S. Pat. Nos. 3,405,381 and 3,517,436.

It will also be recognized that FIGS. 1, 2 and 3 essentially represent the "prior art" to the present invention.

The construction of FIG. 3 has the prior art disadvantages of high thermal e.m.f. and flexible, weak connecting ribbons 30. The construction of FIGS. 1 and 2, on the other hand, suffers from the problem that the cement in layer 20 may soften and run out from between foil 12 and substrate 11, that the foil 12 may lift from its desired position on substrate 11, or both.

The solution to this problem, in accordance with the present invention, is shown in the remaining Figures of drawings.

Specifically, FIG. 4 shows the same foil-and-substrate assembly 10 as FIG. 1, but with the following important difference. In each terminal pad 14 there have been provided in the embodiment of FIG. 4 apertures 25 positioned in a generally rectangular pattern near the periphery of the terminal pad. These apertures 25 extend through the full thickness of resistive foil 12.

FIG. 4 also shows, partly broken away, the epoxy overcoat 21 which is applied to the upper surface of the foil 12 for its protection. Preferably, as shown in FIG. 4, this overcoat 21 extends over the rim of terminal pad 14 so as to form a frame 21*a* encircling that terminal pad. This frame 21*a* stops short of apertures 25 so that apertures 25 are not covered by the epoxy overcoat frame.

In subsequent processing, there will then be applied leads which are otherwise like the leads 15 in FIGS. 1 and 2, and these are spot-welded to pads 14 in FIG. 4. In so doing, the apertures 25 perform in accordance with the present invention, by permitting local expansion of cement which may become softened by the heat developed from the spot-welding operation. These apertures 25 also provide local escape for gas evolved as a result of this spot-welding. As a result, the tendency which previously existed for the terminal pads 14 to lift from the substrate, and for the junctions to become unreliable, is substantially eliminated.

This prevention of lifting is further helped by the presence of frame 21*a* surrounding the outer edge of pads 14. This frame 21*a* creates an adhesive seal around that outer edge and forces the gas to escape essentially through the apertures without pad lifting.

While frame 21*a* is preferred, it will be understood that the invention can also be practiced in the absence of that frame.

It has been found that many specific configurations of apertures 25 may be used. Other such configurations and patterns of apertures are illustrated in FIGS. 5 through 8.

Still other configurations of such apertures may be used. For example, the individual apertures need not be slot-shaped as in FIGS. 4, and 6 through 8, or circular as in FIG. 5, but may for example have triangular, square or other shapes.

In any event, after a construction such as shown in FIGS. 4 through 8 has been provided, the resistor is completed by the same steps as previously discussed with reference to FIGS. 1 and 2, namely by enveloping the entire assembly 10, and its overcoat and the leads spot-welded to the terminal pads, in a rubber-like cushion, and further encapsulating same appropriately. Thus, FIG. 2 essentially also illustrates a completed resistor embodying the present invention, subject only to the recognition that terminal pads 14 therein also include the apertures discussed above and, if desired, a sealing frame around the outer periphery of these terminal pads.

Preferably, the apertures 25 are formed at the same time and by the same process which is used to form the extended serpentine path within foil 12. This may be done in conventional manner by photo-etching in the desired pattern.

The dimensions and other parameters involved in practicing the present invention may be varied to suit the particular application, and it will be understood that, in the drawings, these dimensions are not to scale.

By way of example only, the substrate 10 may be approximately 20 mils thick and 50 by 150 mils in width and length. The foil 12 may be approximately 100 microinches thick, and the total thickness of cement 11, foil 12 and overcoat 21 may be of the order of 1 mil. Typical dimensions for apertures 25 may be 1 mil by 2 mils.

The copper wire leads 19 may be of No. 22 AWG tinned copper wire, i.e. about 25 mils in diameter. The flattened intermediate lead portions 18 may be approximately 10 mils thick by 34 mils wide, and the lead end portions 16 may be approximately 5 mils thick by 30 mils wide and 50 mils long.

For spot-welding there is preferably used a split-electrode welder. That is what accounts for the presence of two welding points 16*a* side-by-side on each lead end 16. The gap between electrodes is preferably about 4 mils, the voltage 0.96 volts, the pressure 2 pounds for electrode dimensions of 25 by 15 mils and a gap of 4 mils, and the duration of application is 14 milliseconds. An atmosphere of 5 cu. ft. per hours of argon may be supplied in the welding operation.

The foregoing dimensions and parameters are all subject to variation depending on the specific application. For example, the thickness of the substrate 11 may range from approximately 10 to 50 mils, and its lateral dimensions from approximately 50 by 150 mils to 215 by 230 mils. The thickness of the combined cement, foil and overcoat may range from approximately one-half to 3 mils, and the thickness of the resistive foil 12 from approximately 30 to 250 microinches.

It will be understood that a protective coating such as overcoat 21 may also extend over the terminal pads 14. This portion of such a coating has to be sufficiently thin and has to have suitable properties to not interfere with the spot-welding of lead ends 16 and with local expansion of cement and escape of gas through apertures 25.

We claim:

1. In a precision resistor which includes a thin resistance foil cemented to a much thicker rigid substrate, and a resistive path between terminal pads defined in the cemented foil, the improvement comprising:

at least one aperture located within the confines of each cemented pad and penetrating through the entire thickness of the foil.

2. The precision resistor of claim 1 wherein each pad comprises a plurality of the said apertures.

3. The precision resistor of claim 2 further comprising:

a flat copper connecting lead lying upon and covering a portion of each pad and spot-welded to the foil of the pad.

4. The precision resistor of claim 3 wherein the lead is a flattened end portion of a conventional copper wire.

5. To precision resistor of claim 4 wherein the lead further includes an additional portion intermediate the flattened end portion and the conventional wire, the additional intermediate portion being also a flattened portion of the wire and extending along the substrate on the side opposite the resistive foil.

6. The precision resistor of claim 5 wherein the substrate is approximately 20 mils thick and the foil approximately 100 microinches, the copper wire is round and approximately 25 mils in diameter and the flattened intermediate and end portions are approximately 10 and 5 mils thick, respectively.

7. The precision resistor of claim 6 further comprising a protective overcoat covering at least the resistive path of the foil.

8. The precision resistor of claim 7 wherein the overcoat also forms a frame covering the outer periphery of the pads but leaving the center area including the apertures uncovered.

9. The precision resistor of claim 7 further comprising a soft, rubber-like cushion enveloping the substrate, foil and overcoat, and means providing an outer encapsulation for the resistor, the copper leads protruding through the outer encapsulating means.

10. The precision resistor of claim 2 wherein the apertures are formed in the foil simultaneously with the resistive path and the terminal pads.

11. The precision resistor of claim 10 wherein the forming of the apertures is by photo-etching of the foil.

12. In a precision resistor which includes a thin resistance foil cemented to a much thicker rigid substrate, and a resistive path between terminal pads defined in the foil, the improvement comprising:

a plurality of apertures located within the confines of each pad and penetrating through the entire thickness of the foil, a flat copper connecting lead lying upon and covering a portion of each pad and spot-welded to the foil of the pad, at least some of the apertures in the terminal pads being not covered by the flat connecting leads lying upon the pads.

13. In a precision resistor which includes a thin resistance foil cemented to a much thicker rigid substrate, and a resistive path between terminal pads defined in the foil, the improvement comprising:

a plurality of apertures located within the confines of each pad and penetrating through the entire thickness of the foil, a flat copper connecting lead lying upon and covering a portion of each pad and spot-welded to the foil of the pad, the apertures being arranged generally along the periphery of each pad.

14. The precision resistor of claim 13 wherein the apertures are rectangular and extend lengthwise parallel to the respective adjoining edges of the pads.

15. The precision resistor of claim 14 wherein the apertures are approximately 1 by 2 mils in size.

16. The precision resistor of claim 12 wherein the apertures are circular.

17. The precision resistor of claim 12 wherein the apertures are sufficient to permit local expansion of cement softened by the spot-welding, and local escape of gas evolved by the spot-welding, without substantial lifting of the terminal pads from the substrate.

18. The precision resistor of claim 17 wherein the spot-welding is by split-electrode welding at a voltage of approximately 0.96 volts, electrode dimensions of approximately 25 by 15 mils, a pressure of approximately 2 pounds, and a duration of approximately 14 milliseconds.

19. The precision resistor of claim 3 wherein the resistive path includes a plurality of portions in approximately logarithmic progression.

20. A subassembly for a precision resistor, said subassembly comprising a thin resistance foil connected to a much thicker rigid substrate, said foil having defined therein a resistive path between terminal pads, and a plurality of apertures located within the confines of each pad and penetrating through the entire thickness of the foil.

21. The subassembly of claim 20 further comprising an overcoat of epoxy extending over at least the resistive path.

22. The subassembly of claim 21 wherein the overcoat also encircles each pad, leaving exposed the center portion of the pad and the apertures.

23. The subassembly of claim 21 further comprising a connecting lead spot-welded to each pad.

24. A precision resistor manufactured by the method which comprises the steps of:

defining in a thin foil of resistance material a resistive path extending between two terminal pads, defining within the confines of each terminal pad a plurality of apertures extending through the thickness of the pad, cementing the foil to a much thicker substrate of a rigid material, before or after defining the resistive path and terminal pads, applying an overcoat at least to the resistive path, applying a connecting lead to the surface of such pad, and spot-welding the leads to the pads under such conditions that the heat of the spot-welding softens the cement between foil and substrate and causes gas at high pressure to evolve between foil and substrate, and the apertures being proportioned so that the softened cement expands locally and the gas escapes through the apertures, whereby there is no substantial lifting of the pads from the substrate as a result of the spot-welding.

25. The method of manufacturing a precision resistor which comprises the steps of:

defining in a thin foil of resistance material a resistive path extending between two terminal pads, defining within the confines of each terminal pad a plurality of apertures extending through the thickness of the pad, cementing the foil to a much thicker substrate of a rigid material, before or after defining the resistive path and terminal pads, applying an overcoat at least to the resistive path, applying a connecting lead to the surface of each pad, and spot-welding the leads to the pads under such conditions that the heat of the spot-welding softens the cement between foil and substrate and causes gas at high pressure to evolve between foil and substrate, and the apertures being proportioned so that the softened cement expands locally and the gas escapes through the apertures, whereby there is no substantial lifting of the pad from the substrate as a result of the spot-welding.

* * * * *